US008246360B1

(12) United States Patent
Tsai et al.

(10) Patent No.: US 8,246,360 B1
(45) Date of Patent: Aug. 21, 2012

(54) ELECTRICAL CONNECTOR

(75) Inventors: Shang Ju Tsai, Keelung (TW); Yan Xian Yuan, Guangzhou (CN)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 13/183,853

(22) Filed: Jul. 15, 2011

(30) Foreign Application Priority Data

Jan. 28, 2011 (CN) ..... 2011 2 0031855 U

(51) Int. Cl.
*H01R 12/00* (2006.01)

(52) U.S. Cl. ..... 439/83; 439/66

(58) Field of Classification Search ..... 439/83, 439/66, 343, 342, 876, 76, 78, 346, 855, 439/858
See application file for complete search history.

(56) References Cited

U.S. PATENT DOCUMENTS 6,572,397 B2 * 6/2003 Ju ..... 439/342
7,147,489 B1 * 12/2006 Lin ..... 439/83
7,377,789 B1 * 5/2008 Liu ..... 439/66
7,828,562 B2 * 11/2010 Wu ..... 439/83
8,052,434 B2 * 11/2011 Yeh et al. ..... 439/83
2006/0258191 A1 * 11/2006 Chen ..... 439/83
* cited by examiner

*Primary Examiner* — Renee Luebke
*Assistant Examiner* — Harshad Patel
(74) *Attorney, Agent, or Firm* — Morris Manning & Martin LLP; Tim Tingkang Xia, Esq.

(57) ABSTRACT

An electrical connector with a plurality of solder balls arranged therein. In one embodiment, the electrical connector includes: an insulating body, wherein a plurality of receiving slots are formed through the insulating body, and at least one side surface of each receiving slot forms a stop wall; and a plurality of conductive terminals, received in the receiving slots. Each conductive terminal has a base, at least one fixing portion extends downwards from the base, and a soldering portion is bent laterally and extends from the fixing portion. The soldering portion includes a soldering arm and a hook portion bent and extending from a lower end of the soldering arm towards the stop wall. The solder ball is clamped between the soldering portion and the stop wall. The hook portion has at least one retaining point urging against a lower hemispherical surface of the solder ball.

11 Claims, 9 Drawing Sheets

ELECTRICAL CONNECTOR

CROSS-REFERENCE TO RELATED APPLICATIONS

This non-provisional application claims priority under 35 U.S.C. §119(a) on Patent Application No. 201120031855.2 filed in China on Jan. 28, 2011, the entire contents of which are hereby incorporated by reference.

FIELD OF THE INVENTION

The present invention relates to an electrical connector, and more particularly to an electrical connector for connecting a chip module.

BACKGROUND OF THE INVENTION

An electrical connector commonly seen in the industry has a plurality of solder balls arranged therein, and includes: an insulating body, wherein a plurality of receiving slots are formed through the insulating body, and at least one side of each receiving slot forms a stop wall; and a plurality of conductive terminals, wherein each conductive terminal is correspondingly received in one of the receiving slots, each conductive terminal has a base, two soldering portions extend vertically downwards from the base, the solder ball is movably received between the stop wall and the two soldering portions, and the two soldering portions are both in contact with the most protruding portions of the solder ball.

In the prior art, the electrical connector has the following defects.

1. Since the soldering portions extend vertically downwards from the base, the two soldering portions must cooperate with the stop wall so as to retain the solder ball. Since the soldering portions are both in contact with the most protruding portions of the solder ball, the solder ball may be displaced relative to the prearranged position during transportation or other unexpected operations. Since the soldering portions are only in contact with the most protruding portions of the solder ball, the solder ball may move upwards and downwards relative to the receiving slot once departing from the prearranged position, resulting in poor soldering.

2. In a soldering environment without inert gases, when a solder paste is provided to solder the conductive terminal onto a circuit board located below the insulating body through the solder ball, since the two soldering portions are both in contact with the most protruding portions of the solder ball, a height difference exists between the solder paste and the two soldering portions, so that the solder paste and the soldering portions cannot contact each other over a large area, and the solder flux in the solder paste is not sufficient to remove the oxide layer on the surface of the soldering portion. As such, the soldering portions cannot fully electrically contact the solder ball, resulting in poor soldering.

3. The most important is that, when the solder ball is inserted and presses against the soldering portions, the soldering portions elastically move away from the stop wall, and when the solder ball reaches the prearranged position, an elastic restoring force exerted on the solder ball by the soldering portions is limited as the soldering portions extend vertically downwards from the base, which leads to a small elastic restoring force and slow elastic restoration, so that the soldering portions cannot be in close interference with the solder ball.

Therefore, a heretofore unaddressed need exists in the art to address the aforementioned deficiencies and inadequacies.

SUMMARY OF THE INVENTION

In one aspect, the present invention is directed to an electrical connector capable of securely retaining a solder ball.

In one embodiment, the present invention provides an electrical connector with a plurality of solder balls arranged therein. The electrical connector includes an insulating body, wherein a plurality of receiving slots are formed through the insulating body, and at least one side surface of each receiving slot forms a stop wall; and a plurality of conductive terminals, received in the receiving slots, wherein each conductive terminal has a base, at least one fixing portion extends downwards from the base, a soldering portion is bent laterally and extends from the fixing portion, the soldering portion includes a soldering arm and a hook portion bent and extending from a lower end of the soldering arm towards the stop wall, the solder ball is clamped between the soldering portion and the stop wall, and the hook portion has at least one retaining point urging against a lower hemispherical surface of the solder ball.

Compared with the prior art, among other things, the electrical connector of the present invention has the following advantages.

1. The hook portion is bent and extends from the lower end of the soldering arm towards the stop wall, the solder ball is clamped between the soldering portion and the stop wall, and the hook portion has at least one retaining point urging against the lower hemispherical surface of the solder ball, so that during transportation or other unexpected operations, the retaining point can prevent the solder ball from moving upwards and downwards relative to the receiving slot, thereby ensuring good soldering.

2. In a soldering environment without inert gases, when a solder paste is provided to solder the conductive terminal onto a circuit board located below the insulating body through the solder ball, since the hook portion has at least one retaining point urging against the lower hemispherical surface of the solder ball, that is, the height difference between the solder paste and the hook portion is small, the solder paste contacts the hook portion over a large area, and the solder flux in the solder paste is sufficient to remove the oxide layer on the surface of the hook portion. As such, the hook portion fully electrically contacts the solder ball, thereby ensuring good soldering.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
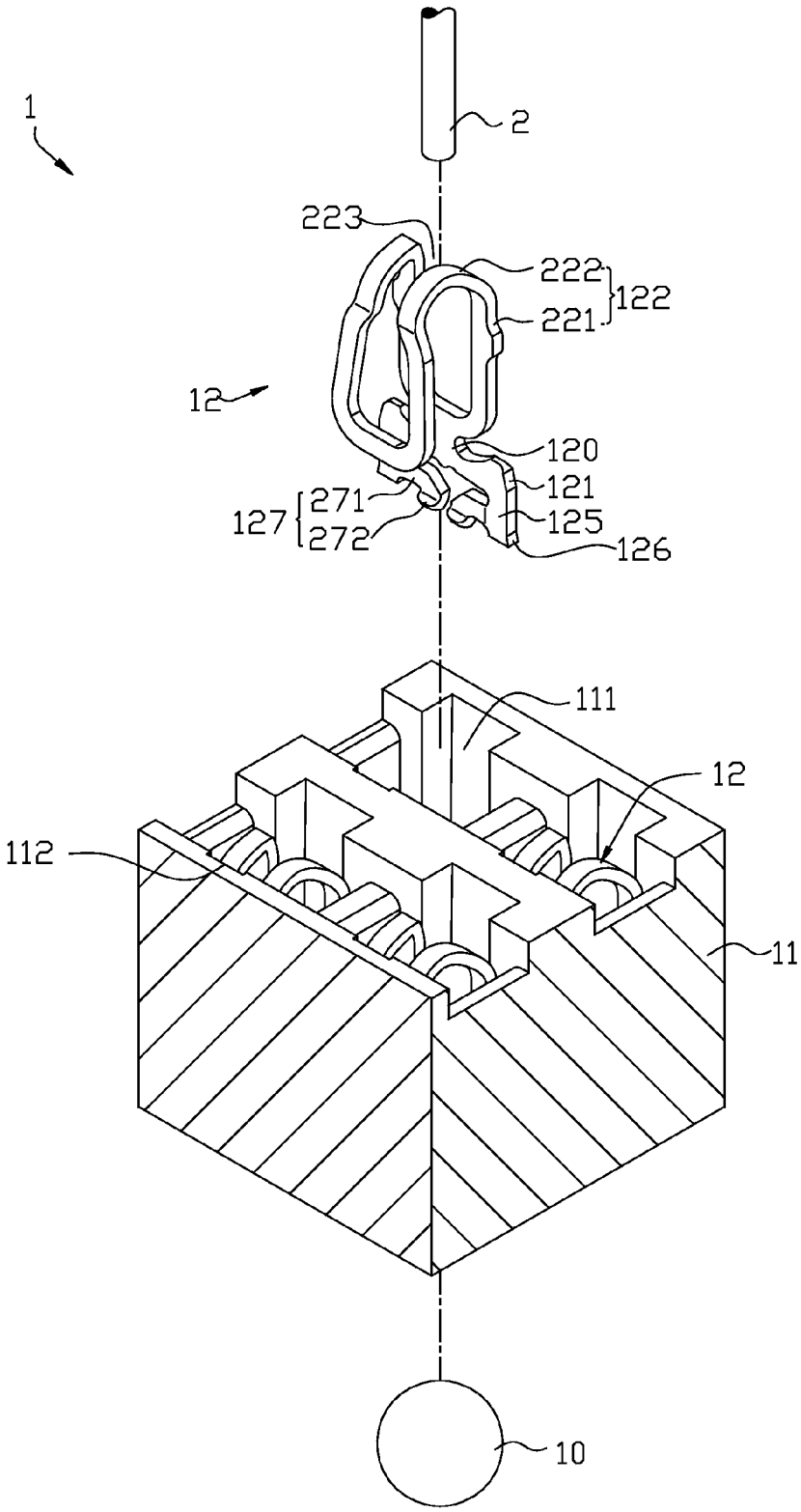
FIG. 1 is a three-dimensional exploded view of an electrical connector in one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

Figure 7:
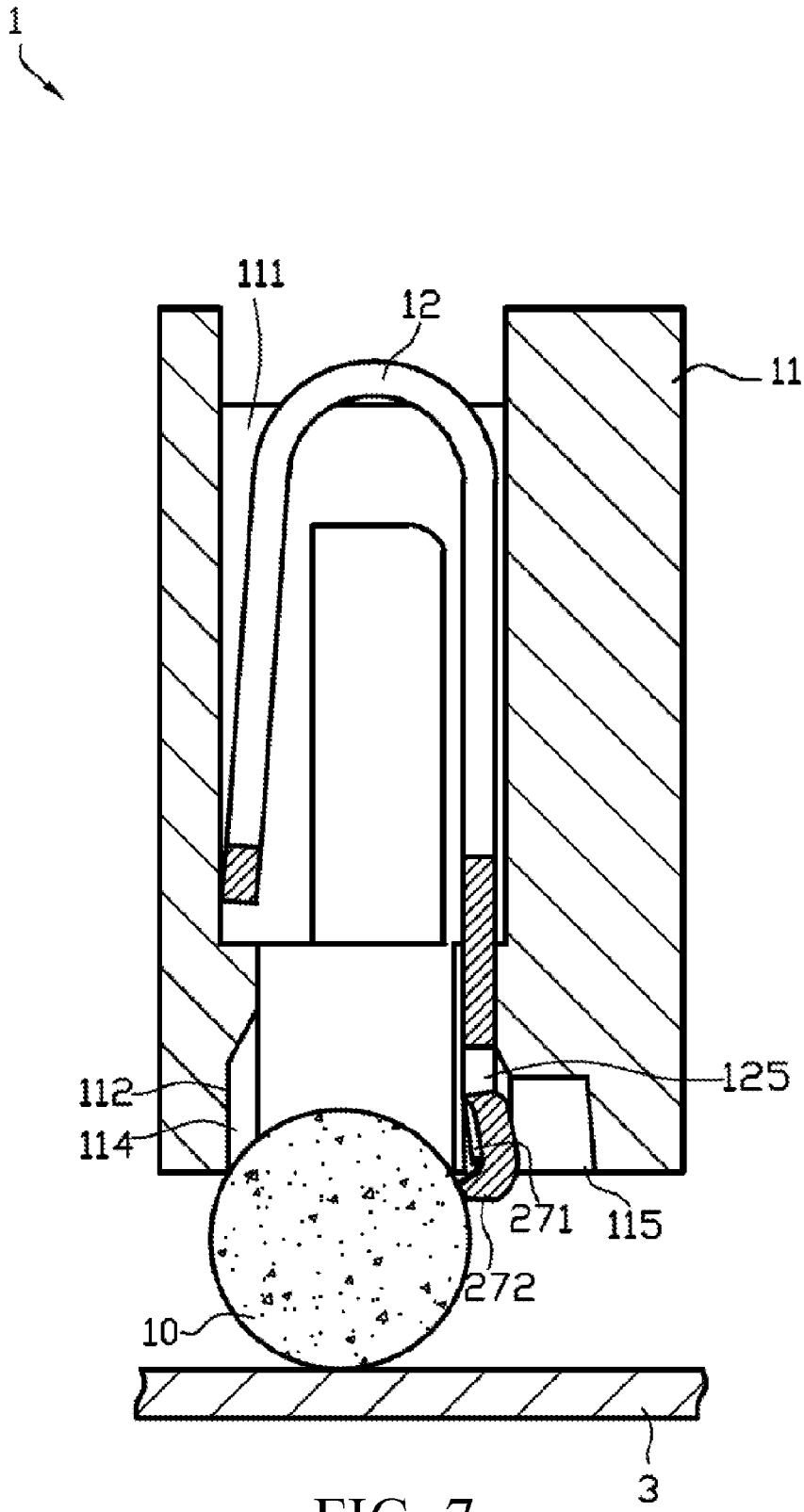
FIG. 7 is a sectional view of the electrical connector in one embodiment of the present invention when the solder ball partially enters a retaining space.

Referring to FIG. 1 and FIG. 7, the electrical connector 1 in one embodiment of the present invention is used for electrically connecting an electronic component 2 to a circuit board 3.

Figure 2:
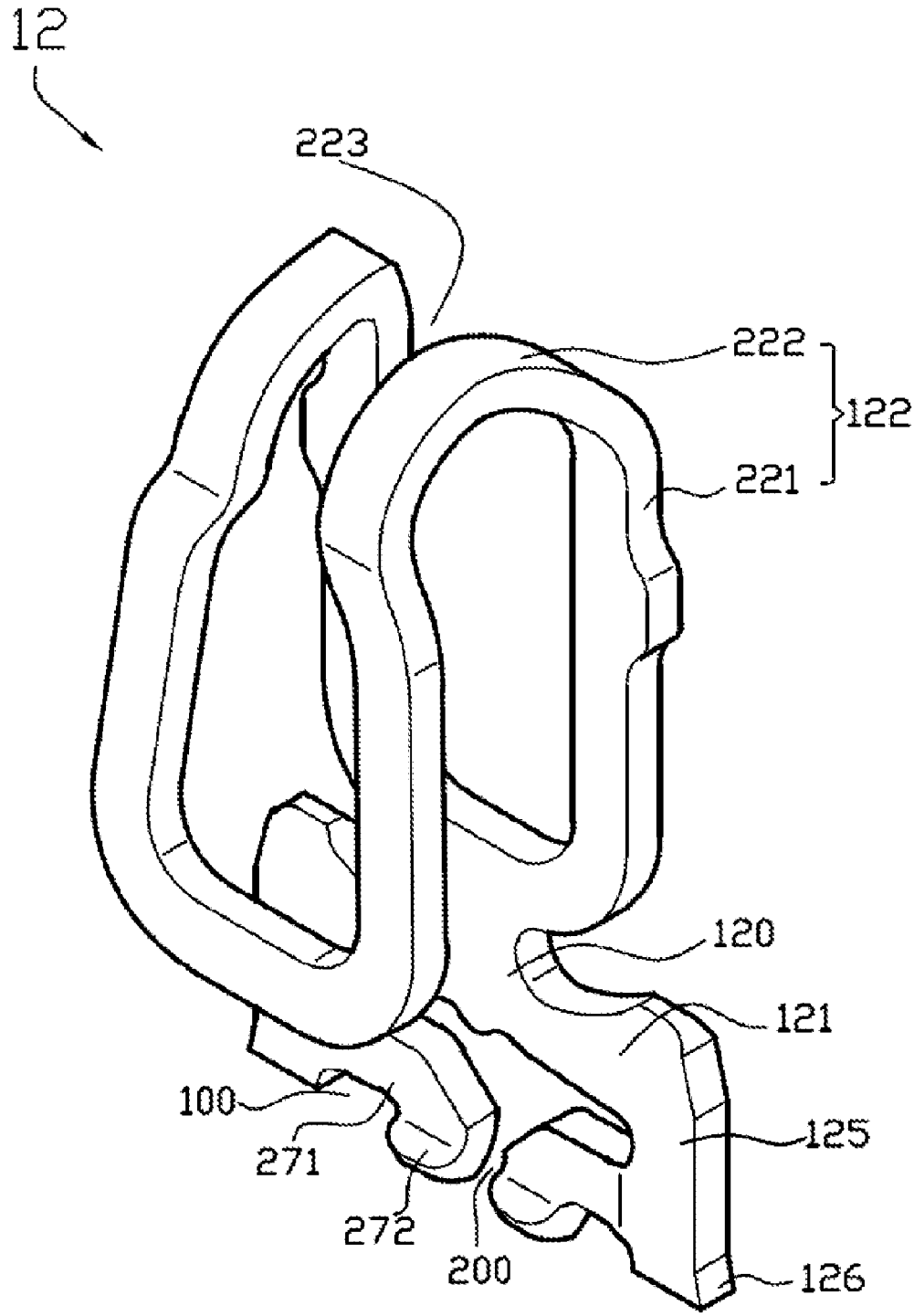
FIG. 2 is a schematic view of a conductive terminal of the electrical connector in one embodiment of the present invention.

Referring to FIG. 1 and FIG. 2, the electrical connector 1 has a plurality of solder balls 10 arranged therein, and includes an insulating body 11 and a plurality of conductive terminals 12 received in the insulating body 11.

Figure 6:
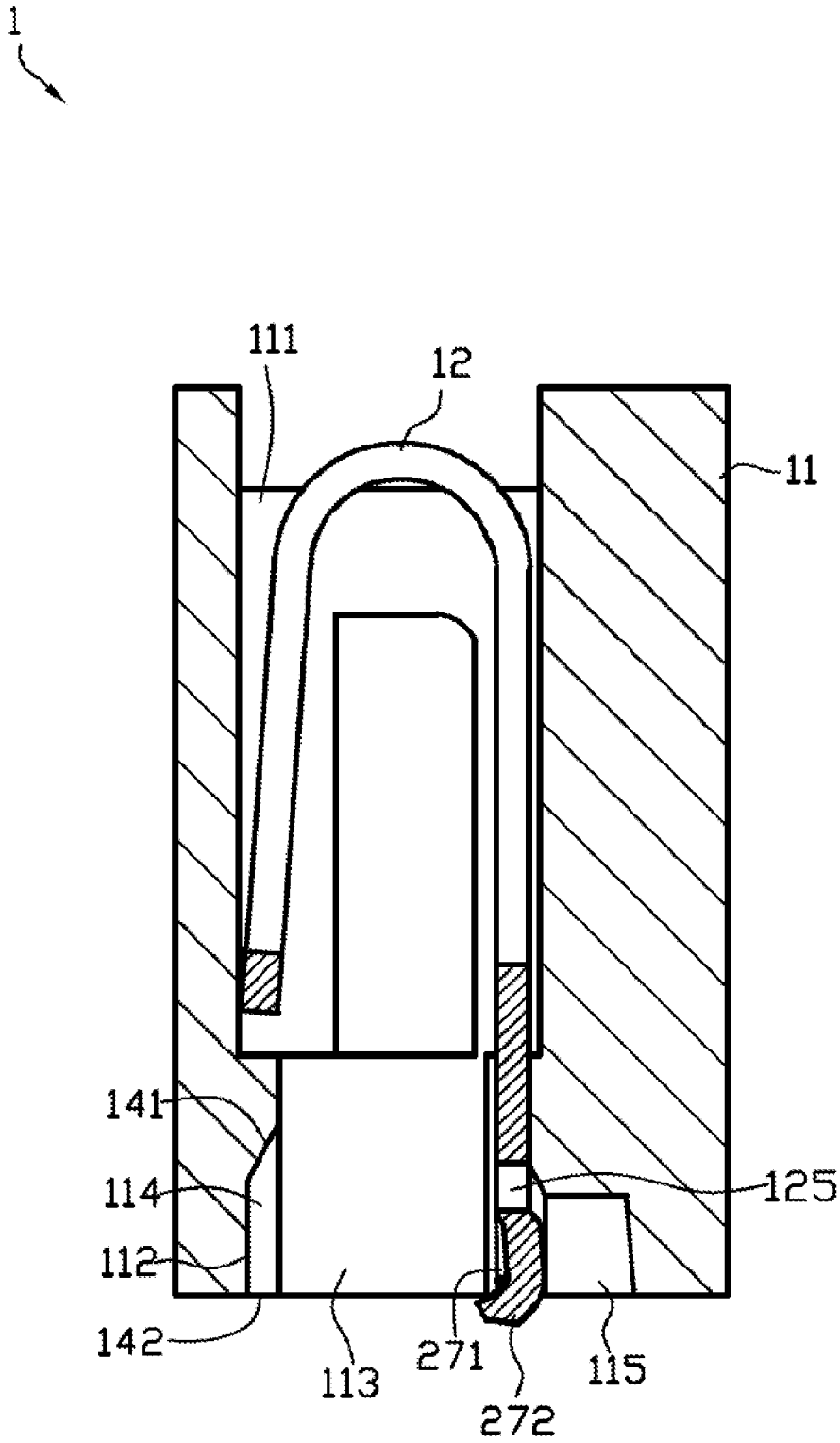
FIG. 6 is a sectional view of the electrical connector in one embodiment of the present invention with no solder ball inserted therein.

Referring to FIG. 1 and FIG. 6, the insulating body 11 is formed by injection molding. A plurality of receiving slots 111 are formed through the insulating body 11. A side surface of each receiving slot 111 forms a stop wall 112. A retaining space 113 for receiving one of the solder balls 10 is formed at an end of the receiving slot 111 adjacent to the circuit board 3. The retaining space 113 is recessed with a limiting groove 114. The limiting groove 114 has a first stop surface 141 and a second stop surface 142. The first stop surface 141 and the second stop surface 142 are disposed opposite to each other to stop upward and downward displacements of the solder ball 10. The stop wall 112 and the conductive terminal 12 are disposed opposite to each other to stop leftward and rightward displacements of the solder ball 10. The first stop surface 141, the second stop surface 142 and the stop wall 112 jointly surround the solder ball 10 to stop a spatial displacement of the solder ball 10.

Referring to FIG. 1, FIG. 6 and FIG. 7, the retaining space 113 extends away from the stop wall 112 to form a reserved space 115 allowing the conductive terminal 12 to move towards a side surface opposite to the stop wall 112 when the solder ball 10 is forced to enter the retaining space 113. The reserved space 115 is connected with the retaining space 113. When the solder ball 10 does not enter the retaining space 113, the conductive terminal 12 is located in the retaining space 113. When the solder ball 10 is forced to enter the retaining space 113, the conductive terminal 12 elastically moves towards the reserved space 115 and partially enters the reserved space 115.

Figure 3:
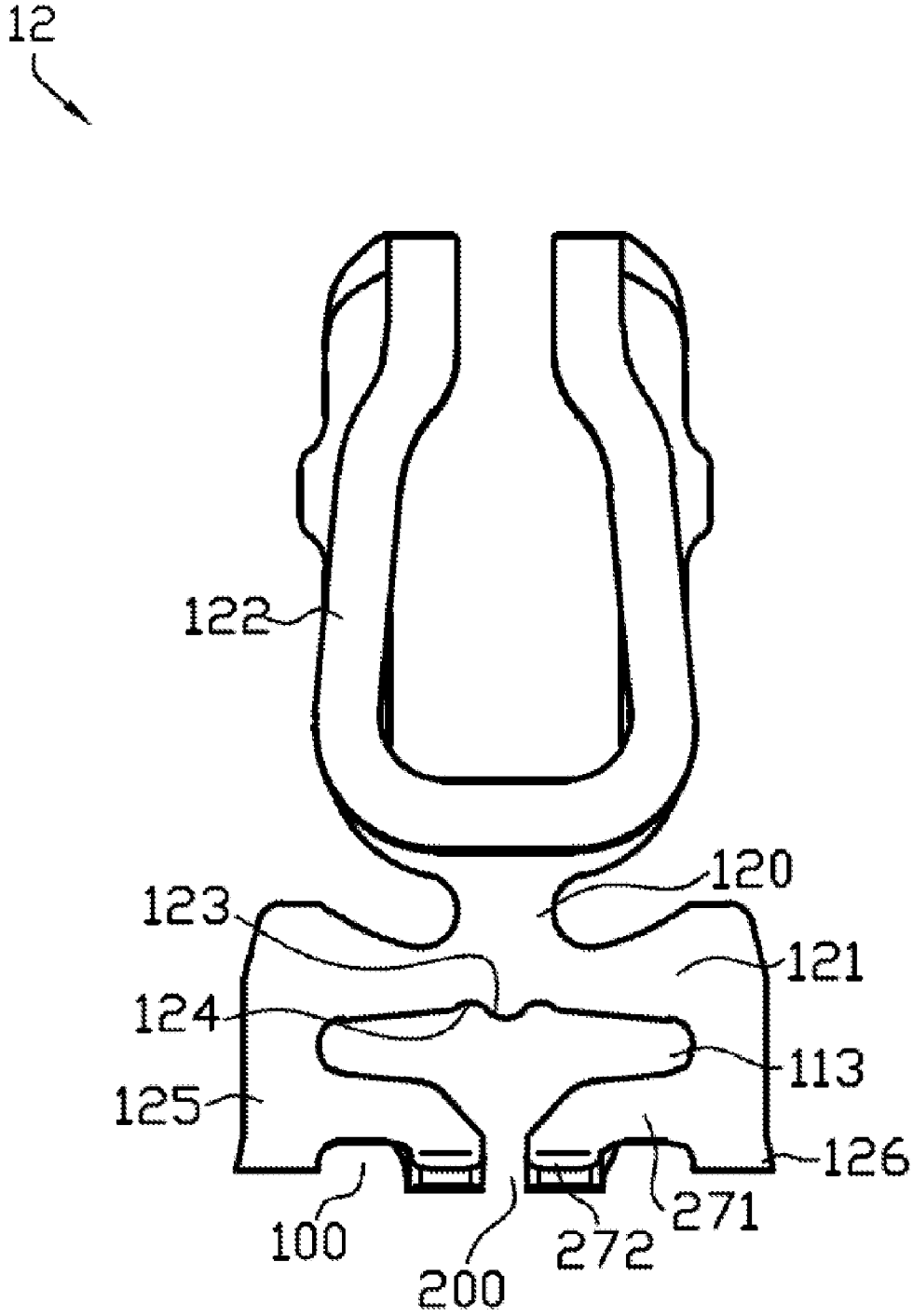
FIG. 3 is a front view of the conductive terminal of the electrical connector in one embodiment of the present invention.
Figure 4:
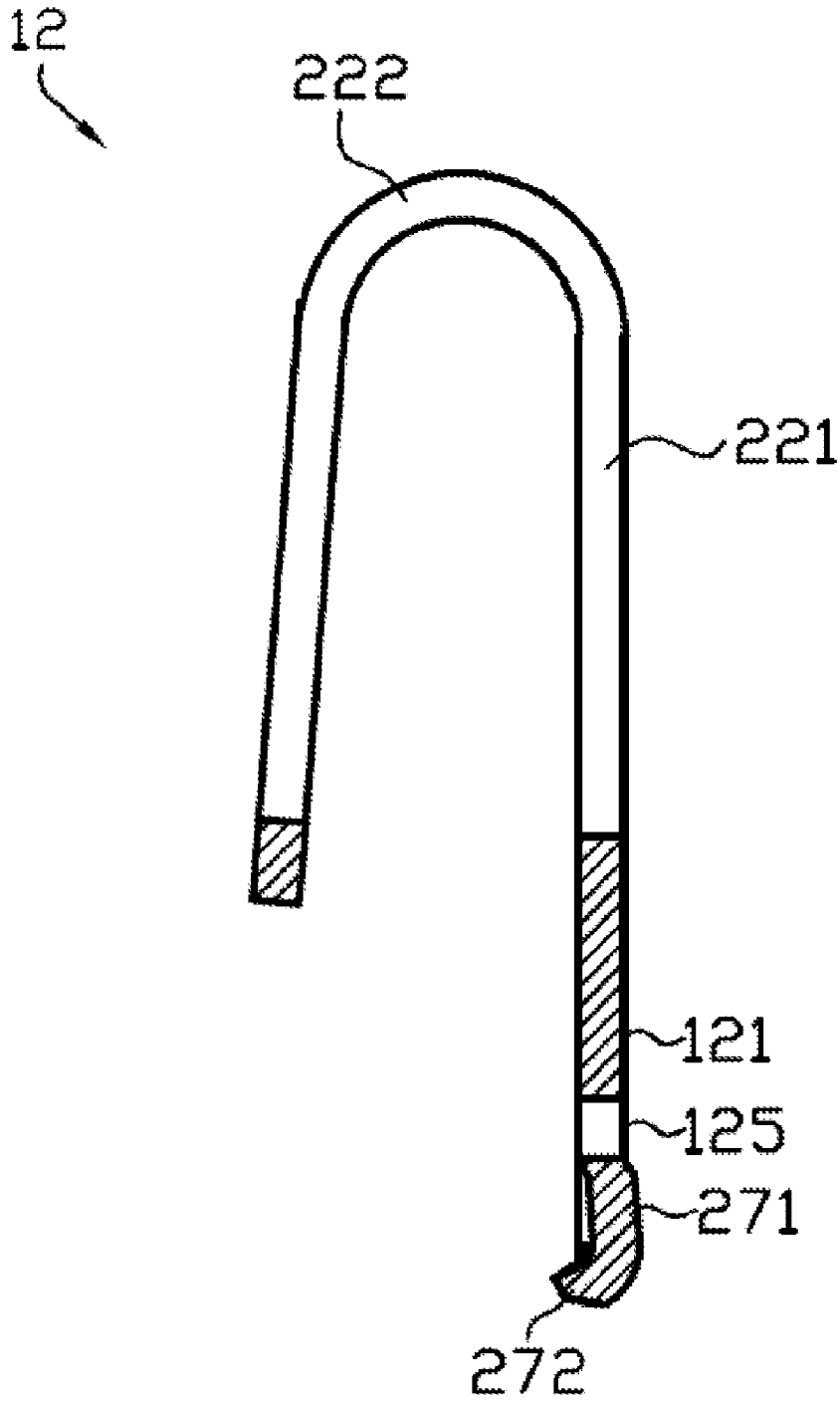
FIG. 4 is a sectional view of the conductive terminal of the electrical connector in one embodiment of the present invention.

Referring to FIGS. 2-4, the conductive terminal 12 is formed by stamping a metal plate, and is substantially in the shape of an inverted U. Each conductive terminal 12 has a base 121 received in the receiving slot 111, and the base 121 is substantially in a flat plate shape. A connecting portion 120 extends upwards from the base 121. The connecting portion 120 is located at a middle position above the base 121, and the width of the connecting portion 120 is smaller than the width of the base 121. Two sides of the connecting portion 120 respectively extend and are respectively bent upwards to form an elastic arm 122. Each elastic arm 122 has two opposite arm portions 221 and a contact portion 222. The two arm portions 221 are disposed in parallel and the contact portion 222 connects the two arm portions 221. An insertion space 223 is formed between the contact portions 222 located on the two elastic arms 122 to allow insertion of the electronic component 2 to conduct the conductive terminal 12.

Referring to FIG. 2 and FIG. 3, a protruding block 123 projects downwards from a bottom surface of the base 121 for stopping the upward displacement of the solder ball 10. When the solder ball 10 is in a molten state, the protruding block 123 penetrates into the solder ball 10, and is in close interference with the solder ball 10. Two sides of the protruding block 123 are respectively recessed with a recessed portion 124 for distributing the stress borne by the protruding block 123.

Referring to FIGS. 2-4, two fixing portions 125 extend downwards from the base 121. The two fixing portions 125 are disposed at an interval. The fixing portion 125 is provided with a protruding barb 126 corresponding to the receiving slot 111, which is in interference with the receiving slot 111 to fix the conductive terminal 12 into the receiving slot 111.

Referring to FIG. 2 and FIG. 3, the two fixing portions 125 are bent and extend towards each other to form two soldering portions 127. The retaining space 113 is formed between the base 121 and the two soldering portions 127. When the solder ball 10 is inserted, the solder ball 10 partially enters the retaining space 113.

Figure 8:
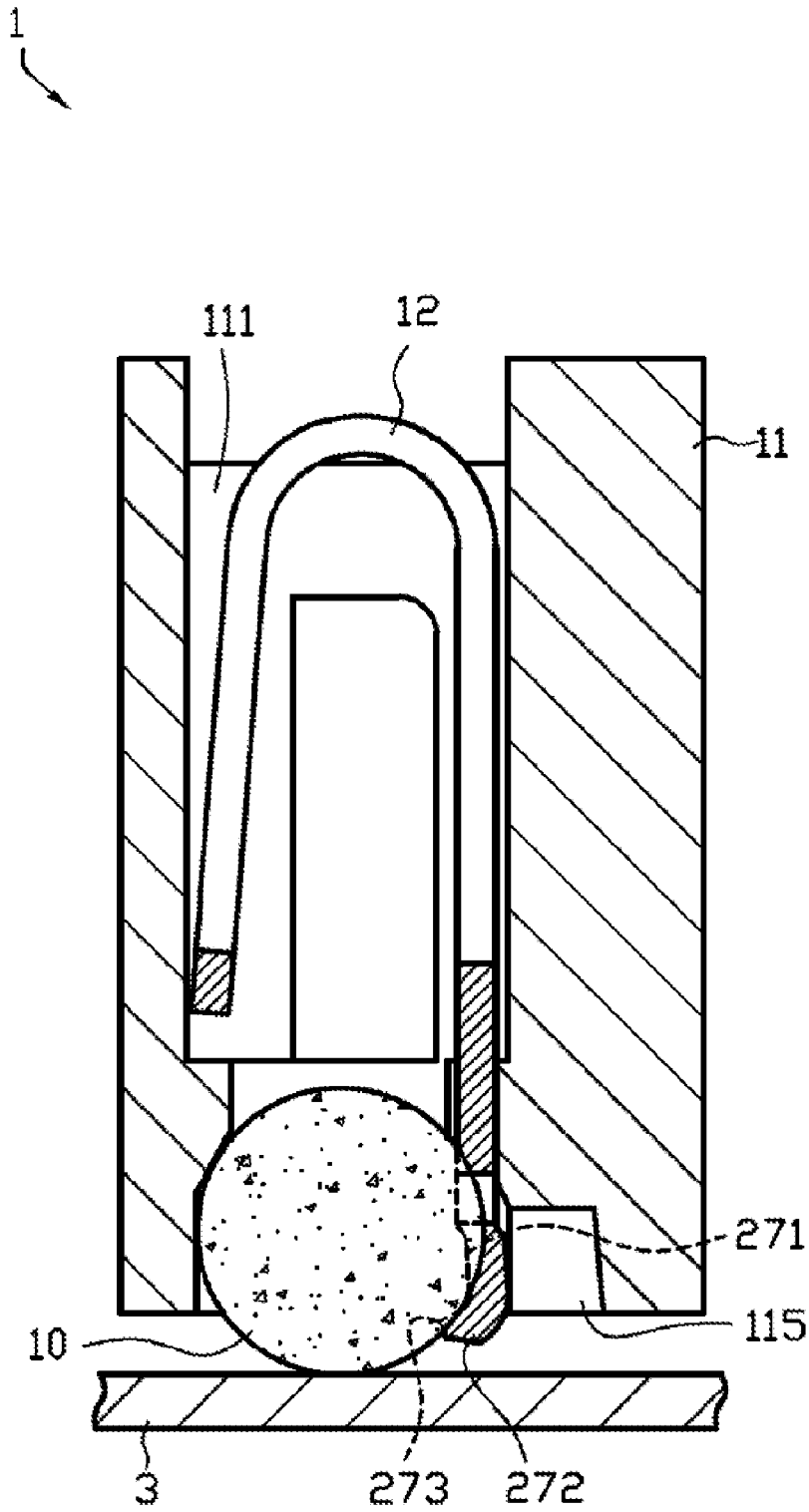
FIG. 8 is a sectional view of the electrical connector in one embodiment of the present invention when the solder ball substantially enters a retaining space.
Figure 9:
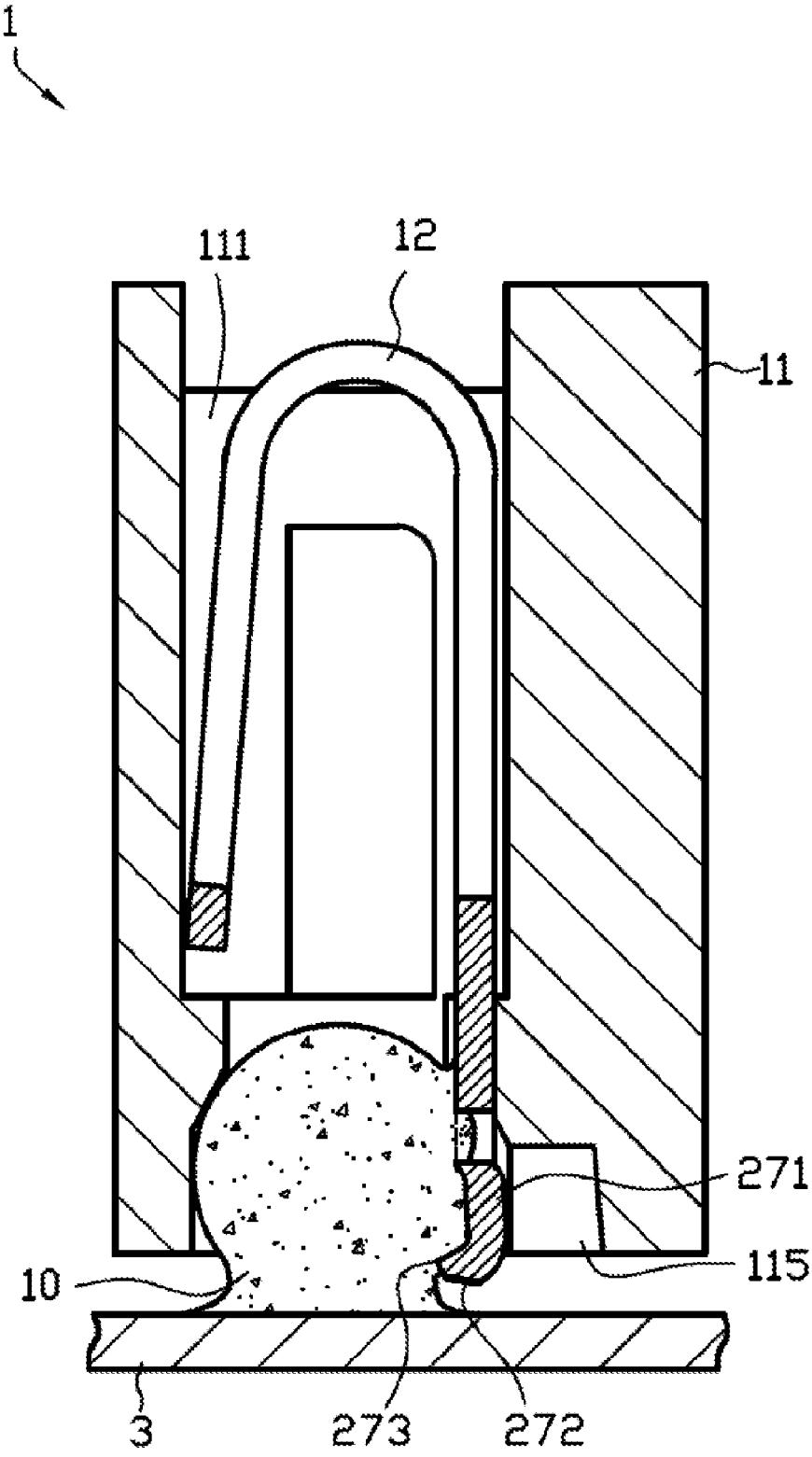
FIG. 9 is a sectional view of the electrical connector in one embodiment of the present invention when the solder ball is in a molten state.

Referring to FIG. 2, FIG. 4 and FIG. 8, an opening 100 is formed between each soldering portion 127 and the adjacent fixing portion 125. Each soldering portion 127 includes a soldering arm 271 and a hook portion 272 extending from a lower end of the soldering arm 271 towards the stop wall 112. The width of the hook portion 272 is smaller than the width of the soldering arm 271, so as to enhance the elasticity of the hook portion 272. An upper surface of the hook portion 272 is a camber having a radian substantially conforming to a spherical surface of the solder ball 10, and an angle formed between the hook portion 272 and the soldering arm 271 is substantially equal to the radian of the surface of the solder ball 10, so as to increase the contact area with the solder ball 10. A clearance 200 is formed between the two hook portions 272. The clearance 200 separates the two hook portions 272 so that the two hook portions 272 elastically move and enter the reserved space 115 when being pressed. The opening 100 is formed between the hook portion 272 and the adjacent fixing portion 125. When viewed laterally, each hook portion 272 has a retaining point 273 urging against a lower hemispherical surface of the solder ball 10 to hold the solder ball 10, so as to prevent the solder ball 10 from moving downwards relative to the receiving slot 111.

In other embodiments (not shown), the number of the fixing portion 125 may also be one. That is, a fixing portion 125 extends downwards from the base 121. A soldering portion 127 is bent laterally and extends from the fixing portion 125. The soldering portion 127 includes a soldering arm 271 and a hook portion 272 bent and extending from a lower end of the soldering arm 271 towards the stop wall 112. The solder ball 10 is clamped between the soldering portion 127 and the stop wall 112, and the hook portion 272 has a retaining point 273 urging against a lower hemispherical surface of the solder ball 10.

Figure 5:
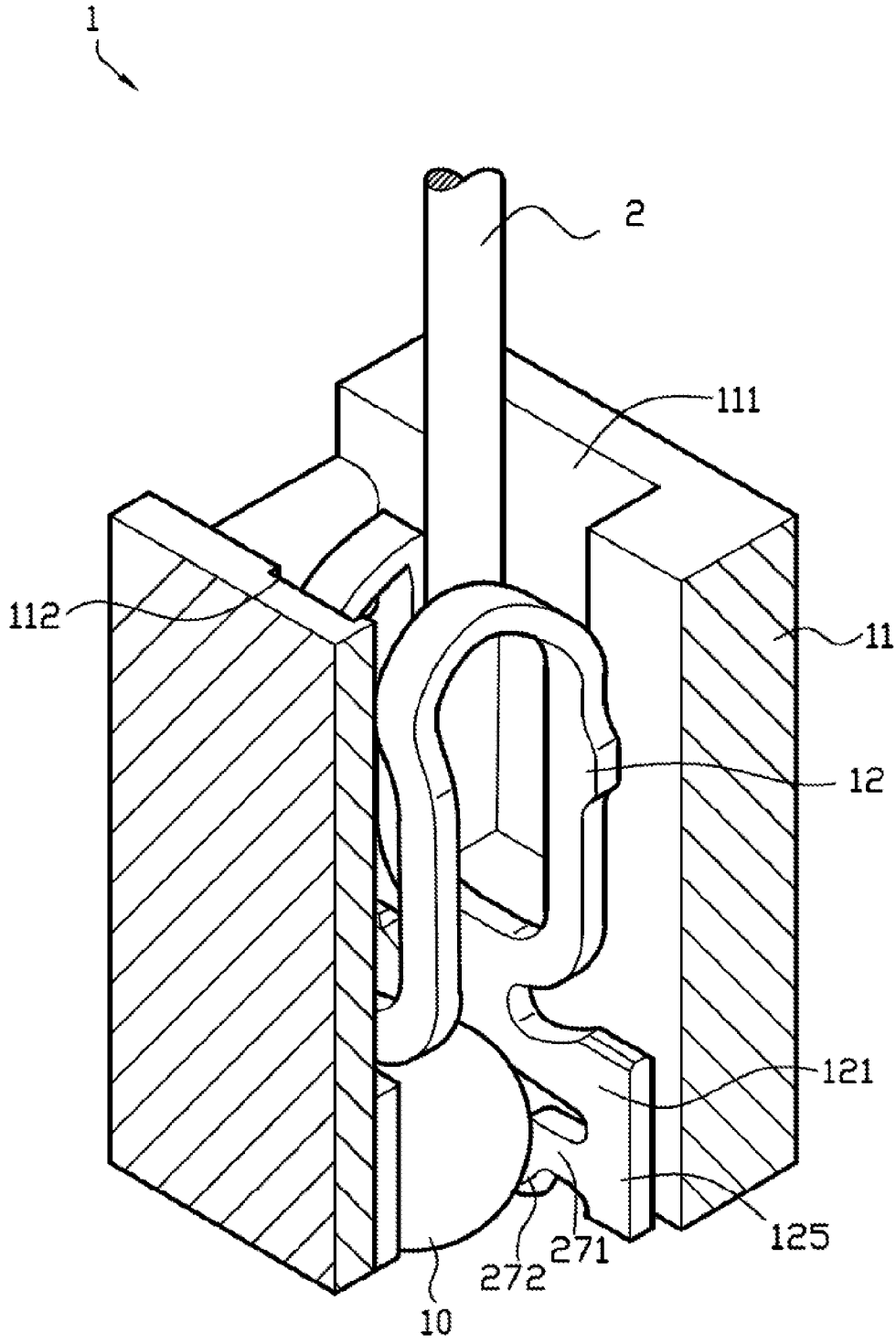
FIG. 5 is a schematic assembled view of the electrical connector in one embodiment of the present invention.

In operation, referring to FIG. 2, FIG. 5 and FIG. 6, first, the conductive terminal 12 is inserted into the receiving slot 111 so that the base 121 is fixed in the receiving slot 111, the protruding barb 126 located on the fixing portion 125 is buckled in the receiving slot 111 to fix the conductive terminal 12, and the electronic component 2 is inserted into the insertion space 223. At this time, the soldering portion 127 and the hook portion 272 are in a pre-bent state and the hook portion 272 is bent relative to the soldering arm 271, and the soldering portion 127 is located in the retaining space 113.

Referring to FIG. 2, FIG. 6 and FIG. 7, one of the solder balls 10 is correspondingly placed in the retaining space 113. The solder ball 10 is in interference with the soldering portion 127 and the solder ball 10 presses the soldering portion 127 to elastically move towards the reserved space 115 so that the solder ball 10 is securely retained between the soldering portion 127 and the stop wall 112. At this time, the soldering portion 127 partially enters the reserved space 115, and the solder ball 10 partially enters the retaining space 113.

Referring to FIG. 2, FIG. 7 and FIG. 8, the solder ball 10 is further inserted. The solder ball 10 presses the soldering portion 127 to elastically move towards the reserved space 115, the retaining point 273 located on the hook portion 272 tightly urges against the lower hemispherical surface of the solder ball 10, and the spherical surface of the solder ball 10 conforms to and contacts the upper surface of the hook portion 272, and finally the solder ball 10 is substantially retained between the soldering portion 127 and the stop wall 112. At this time, the elastic pressing force received by the hook portion 272 is the strongest. Since the clearance 200 exists between the two hook portions 272, and the opening 100 exists between the hook portion 272 and the adjacent fixing portion 125, the hook portion 272 exerts a large elastic restoring force on the solder ball 10, so that the solder ball 10 is displaced towards the stop wall 112 to achieve further close interference of the solder ball 10 with the hook portion 272 and the stop wall 112, so as to further tightly clamp the solder ball 10. At this time, the elastic restoring force exerted on the solder ball 10 by the hook portion 272 is the strongest.

Referring to FIG. 2, FIG. 7, FIG. 8 and FIG. 9, during high-temperature soldering, in a soldering environment without inert gases, the conductive terminal 12 is easily oxidized, and a solder paste (not shown) is provided to solder the conductive terminal 12 onto the circuit board 3 through the solder ball 10. Since the retaining point 273 located on the hook portion 272 tightly urges against the lower hemispherical surface of the solder ball 10, that is, the height difference between the solder paste (not shown) and the hook portion 272 is small, the solder paste (not shown) contacts the hook portion 272 over a large area, and the solder flux in the solder paste (not shown) is sufficient to remove the oxide layer on the surface of the hook portion 272. As such, the hook portion 272 fully electrically contacts the solder ball 10, thereby ensuring good soldering. When the solder ball 10 is in a molten state, the two hook portions 272 and the protruding block 123 penetrate into the solder ball 10, which enhances the interference with the solder ball 10, thereby improving the soldering effect.

Based on the above, the electrical connector of the present invention, among other things, has the following beneficial effects.

1. The hook portion 272 extends from the lower end of the soldering arm 271 towards the stop wall 112, the solder ball 10 is clamped between the two soldering portions 127 and the stop wall 112, and the hook portion 272 has a retaining point 273 urging against the lower hemispherical surface of the solder ball 10, so that during transportation or other unexpected operations, the retaining point 273 can prevent the solder ball 10 from moving upwards and downwards relative to the receiving slot 111, thereby ensuring good soldering.

2. In a soldering environment without inert gas, when the solder paste (not shown) is provided to solder the conductive terminal 12 onto the circuit board 3 located below the insulating body 11 through the solder ball 10, since the hook portion 272 has a retaining point 273 urging against the lower hemispherical surface of the solder ball 10, that is, the height difference between the solder paste (not shown) and the hook portion 272 is small, the solder paste (not shown) contacts the hook portion 272 over a large area, and the solder flux in the solder paste (not shown) is sufficient to remove the oxide layer on the surface of the hook portion 272. As such, the hook portion 272 fully electrically contacts the solder ball 10, thereby ensuring good soldering.

3. When the solder ball 10 is inserted and pressed between the soldering portion 127 and the stop wall 112, the hook portion 272 elastically moves away from the stop wall 112. Since the clearance 200 is formed between the two hook portions 272, the elasticity of the hook portion 272 can be enhanced. When the solder ball 10 reaches the prearranged position, the elastic restoring force exerted on the solder ball 10 by the hook portion 272 is large, and the elastic restoration is fast, so that close interference of the hook portion 272 with the solder ball 10 can be ensured.

4. Since the opening 100 is formed between the soldering portion 127 and the adjacent fixing portion 125, the elasticity of the soldering portion 127 can be enhanced.

5. Since the width of the connecting portion 120 is smaller than the width of the base 121, the elasticity of the soldering portion 127 located below the base 121 can be enhanced.

6. Since the protruding block 123 projects from the bottom surface of the base 121, when the solder ball 10 is molten, the protruding block 123 penetrates into the solder ball 10, which enhances the interference with the solder ball 10, thereby improving the soldering effect.

7. Since the upper surface of the hook portion 272 is a camber, the contact area between the hook portion 272 and the solder ball 10 can be increased.

8. Since the two sides of the protruding block 123 is respectively recessed with a recessed portion 124, the recessed portions 124 can distribute the stress borne by the protruding block 123.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated.

Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, with a plurality of solder balls arranged therein, comprising:

a) an insulating body, wherein a plurality of receiving slots are formed through the insulating body, and at least one side surface of each receiving slot forms a stop wall; and b) a plurality of conductive terminals, received in the receiving slots, wherein each conductive terminal has a base, at least one fixing portion extends downwards from the base, a soldering portion is bent laterally and extends from the fixing portion, the soldering portion comprises a soldering arm and a hook portion bent and extending from a lower end of the soldering arm towards the stop wall, the solder ball is clamped between the soldering portion and the stop wall, and the hook portion has at least one retaining point urging against a lower hemispherical surface of the solder ball.

2. The electrical connector according to claim 1, wherein a connecting portion extends upwards from the base, and the width of the connecting portion is smaller than the width of the base.

3. The electrical connector according to claim 1, wherein an upper surface of the hook portion is a camber, and when the solder ball substantially enters the receiving slot, a spherical surface of the solder ball conforms to and contacts the upper surface of the hook portion.

4. The electrical connector according to claim 1, wherein the width of the hook portion is smaller than the width of the soldering arm.

5. The electrical connector according to claim 1, wherein an opening is formed between the hook portion and the adjacent fixing portion.

6. The electrical connector according to claim 1, wherein a retaining space is formed between the base and the soldering portion, and the solder ball partially enters the retaining space.

7. The electrical connector according to claim 6, wherein the retaining space extends away from the stop wall to form a reserved space allowing the hook portion to elastically move towards a side surface opposite to the stop wall when the solder ball is forced to press the soldering arm, and the reserved space is connected with the retaining space.

8. The electrical connector according to claim 1, wherein the stop wall is recessed with a limiting groove, and the limiting groove has at least one stop surface for stopping an upward displacement of the solder ball.

9. The electrical connector according to claim 1, wherein a protruding block for stopping the solder ball projects downwards from a bottom surface of the base, and when the solder ball is in a molten state, the protruding block penetrates into the solder ball; and two sides of the protruding block are respectively recessed with a recessed portion.

10. The electrical connector according to claim 1, wherein the fixing portion is provided with a protruding barb corresponding to the receiving slot, which is in interference with the receiving slot to fix the conductive terminal into the receiving slot.

11. The electrical connector according to claim 1, wherein two fixing portions extend downwards from the base, the two fixing portions are bent and extend towards each other to form two soldering portions, the two soldering portions comprise two soldering arms and two hook portions bent and extending from the lower ends of the two soldering arms towards the stop wall, the solder ball is clamped between the two soldering portions and the stop wall, a clearance is formed between the two hook portions, and the two hook portions respectively have at least one retaining point urging against the lower hemispherical surface of the solder ball.

* * * * *